US009318880B1

(12) United States Patent
Shibata

(10) Patent No.: US 9,318,880 B1
(45) Date of Patent: Apr. 19, 2016

(54) SPARK PLUG FOR INTERNAL COMBUSTION ENGINE

(71) Applicant: DENSO CORPORATION, Kariya, Aichi-pref. (JP)

(72) Inventor: Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/950,486

(22) Filed: Nov. 24, 2015

(30) Foreign Application Priority Data

Nov. 27, 2014 (JP) ..... 2014-240203

(51) Int. Cl.
*H01T 13/20* (2006.01)

(52) U.S. Cl.
CPC ..... *H01T 13/20* (2013.01)

(58) Field of Classification Search
CPC ..... H01T 13/20
USPC ..... 313/141, 130, 142
See application file for complete search history.

(56) References Cited

U.S. PATENT DOCUMENTS

2013/0140975 A1 6/2013 Yoshida et al.

FOREIGN PATENT DOCUMENTS

JP 2013-041753 2/2013
WO WO 2012/042774 4/2012

*Primary Examiner* — Vip Patel
(74) *Attorney, Agent, or Firm* — Nixon & Vanderhye PC

(57) ABSTRACT

A spark plug includes a terminal metal fitting held inside a cylindrical insulator, and a resistor disposed inside the insulator so as to be located between the terminal metal fitting and a center electrode held inside the insulator. The terminal metal fitting includes an engaging portion engaged into the inner peripheral surface of the insulator and a small-diameter portion extending from the engaging portion. The small-diameter portion is formed with ribs extending in an axial direction of the small-diameter portion and projecting outward from the outer peripheral surface of the small-diameter portion. A conductive sealing member is located at least at part on a distal end side of a gap between the outer peripheral surface of the terminal metal fitting and the inner peripheral surface of the insulator.

3 Claims, 6 Drawing Sheets

SPARK PLUG FOR INTERNAL COMBUSTION ENGINE

This application claims priority to Japanese Patent Application No. 2014-240203 filed on Nov. 27, 2014, the entire contents of which are hereby incorporated by reference.

BACKGROUND OF THE INVENTION

1. Field of the Invention

The present invention relates to a spark plug for use in an internal combustion engine of an automobile or the like.

2. Description of Related Art

Generally, a spark plug for use in an internal combustion engine of an automobile or the like includes a cylindrical housing, a cylindrical insulator held inside the housing, a center electrode held inside the insulator, and a ground electrode disposed so as to form a spark discharge gap with the center electrode. Inside the insulator, a terminal metal fitting is disposed such that its proximal end portion projects from the insulator. Between the terminal metal fitting and the center electrode within the insulator, a resistor is disposed for suppressing electrical noise. A sealing member made of copper glass, for example, is filled in a space between the resistor and the terminal metal fitting and in a space between the resistor and the center electrode.

To manufacture the above spark plug, the center electrode is put into the insulator at first. Subsequently, a copper glass powder as a material of the sealing member and a powder material of the resistor are put into the insulator from the proximal end side. Further, the copper glass material is put into the insulator form the proximal end side, and then, the terminal metal fitting is inserted into the insulator from the proximal end side. After that, these components and materials are heated to a predetermined temperature, and the terminal metal fitting is pushed toward the axial distal end side. As a result, the copper glass powder and the resistor powder material are melted to flow and adhere to the respective components within the insulator, so that the center electrode, the terminal metal fitting and the resistor are fixed, and gaps are sealed by the copper glass within the insulator.

Accordingly, the terminal metal fitting inserted into the insulator is applied with a large axial force at its small-diameter portion at the time of manufacturing the spark plug.

Recently, it is required to reduce the sizes of spark plugs to enable reducing the sizes of internal combustion engines and increasing design freedom of the internal combustion engines. Therefore, the inner diameter of the insulator, and the diameter of the small-diameter portion of the terminal metal fitting disposed in the insulator are also required to be smaller. Accordingly, the small-diameter portion may be deformed when applied with a large axial force. In this case, there is a concern that the pressing force applied to the sealing member and the resistor by the terminal metal fitting may be insufficient, or varies greatly, causing the adhesion of the sealing member to the center electrode, the terminal metal fitting and the resistor to be insufficient.

Japanese Patent Application Laid-open No. 2013-41753 proposes to specify dimensions of the terminal metal fitting, for example, the outer diameter and length of the leg part of the terminal metal fitting, to overcome the above problem.

However, if the dimensions of the terminal metal fitting are specified and fixed, the design freedom of the terminal metal fitting and accordingly the design freedom of the spark plug are lowered. For example, this may cause a problem that it is difficult to design spark plugs having various shapes, for example the so-called long-reach spark plug having a large axial length.

SUMMARY

According to an exemplary embodiment, there is provided a spark plug for an internal combustion engine, including:

a cylindrical housing;

a cylindrical insulator held inside the housing;

a center electrode held inside the insulator such that a distal end portion thereof projects from the insulator;

a terminal metal fitting held inside the insulator such that a proximal end portion thereof projects from the insulator;

a ground electrode disposed so as to form a spark discharge gap with the center electrode;

a resistor disposed inside the insulator so as to be located between the center electrode and the terminal metal fitting;

a first conductive sealing material filled in a space surrounded by the resistor, the terminal metal fitting and the insulator; and a second conductive insulating material filled in a space surrounded by the resistor, the center electrode and the insulator, wherein the terminal metal fitting includes an engaging portion engaged into an inner peripheral surface of the proximal end portion of the insulator and a small-diameter portion extending from the engaging portion and having a diameter smaller than a diameter of the engaging portion, the small-diameter portion is formed with ribs extending in an axial direction of the small-diameter portion and projecting outward from an outer peripheral surface of the small-diameter portion, and the first conductive sealing member is located at least at part on a distal end side of a gap between an outer peripheral surface of the terminal metal fitting and the inner peripheral surface of the insulator.

According to the exemplary embodiment, there is provided a spark plug a degree of design freedom of which is high, and whose terminal metal fitting can be prevented from being deformed due to an axial force applied thereto during assembly.

Other advantages and features of the invention will become apparent from the following description including the drawings and claims.

PREFERRED EMBODIMENTS OF THE INVENTION

First Embodiment

A spark plug 1 according to a first embodiment of the invention is described with reference to FIGS. 1 to 6. The spark plug 1 is used for an internal combustion engine of an automobile, a cogeneration system and so on. In the below description, the words "distal end side" means the axial end side of the spark plug 1 inserted into a combustion chamber of an internal combustion engine, and the words "proximal end side" means the other axial end side of the spark plug 1.

Figure 1:
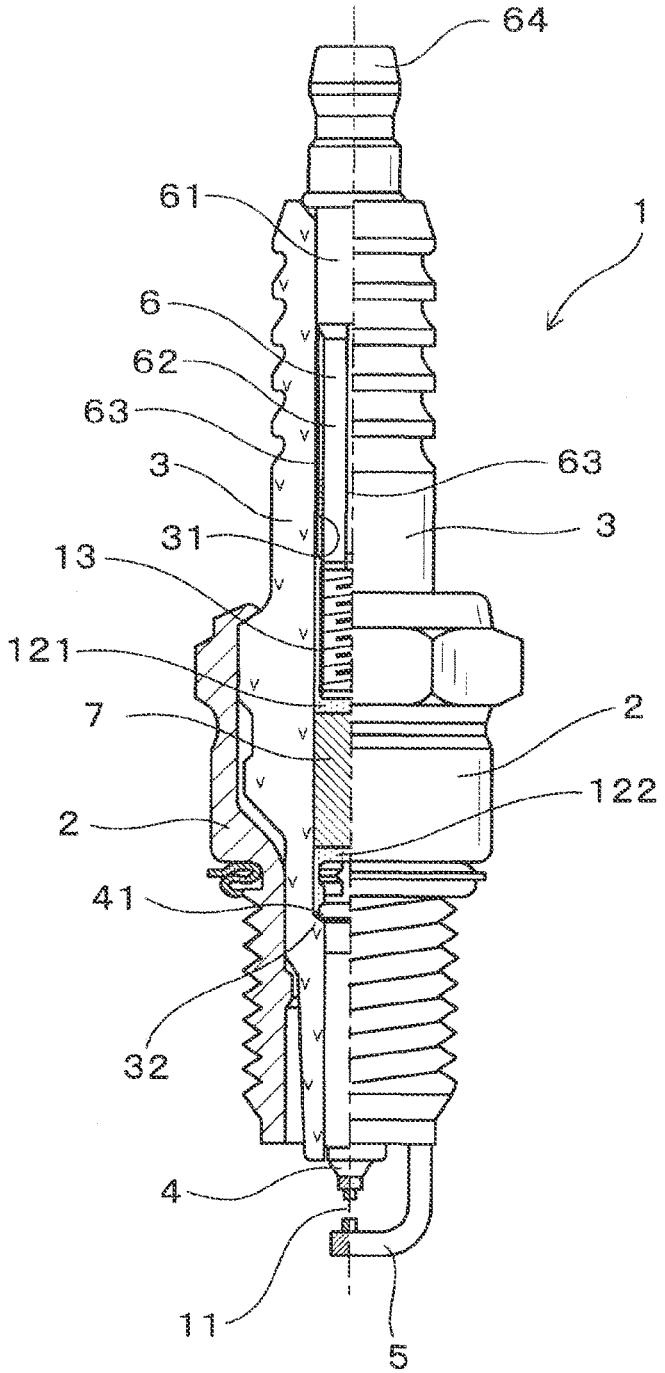
FIG. 1 is a front view partly in cross section of a spark plug according to a first embodiment of the invention.

As shown in FIG. 1, the spark plug 1 includes a cylindrical housing 2, a cylindrical insulator 3 held inside the housing 2, and a center electrode 4 held inside the insulator 3 such that its distal end portion projects from the insulator 3.

The spark plug 1 includes also a terminal metal fitting 6 held inside the insulator 3 such that its proximal end portion projects from the insulator 3, a ground electrode 5 disposed so as to form a spark discharge gap 11 with the center electrode 4, and a resistor 7 disposed between the center electrode 4 and the terminal metal fitting 6 within the insulator 3. A conductive sealing member 121 is filled in a space between the resistor 7 and the terminal metal fitting 6. A conductive sealing member 122 is filled in a space between the resistor 7 and the center electrode 4.

Figure 2:
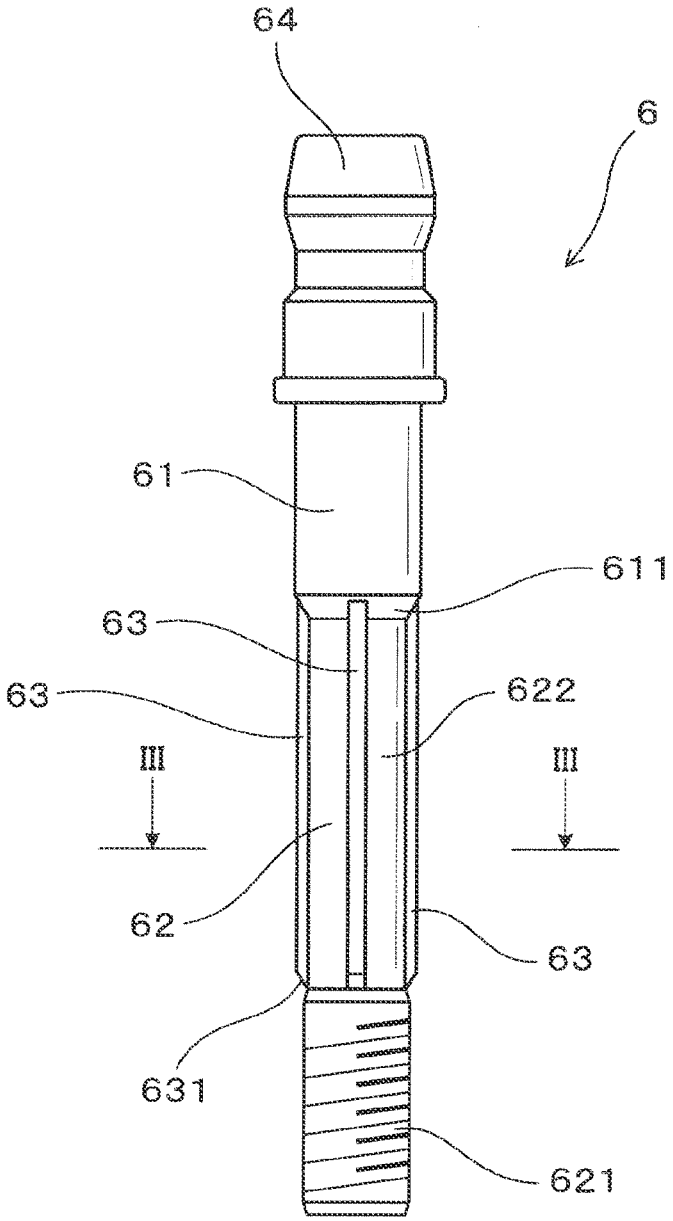
FIG. 2 is a front view of a terminal metal fitting of the spark plug according to the first embodiment of the invention.
Figure 3:
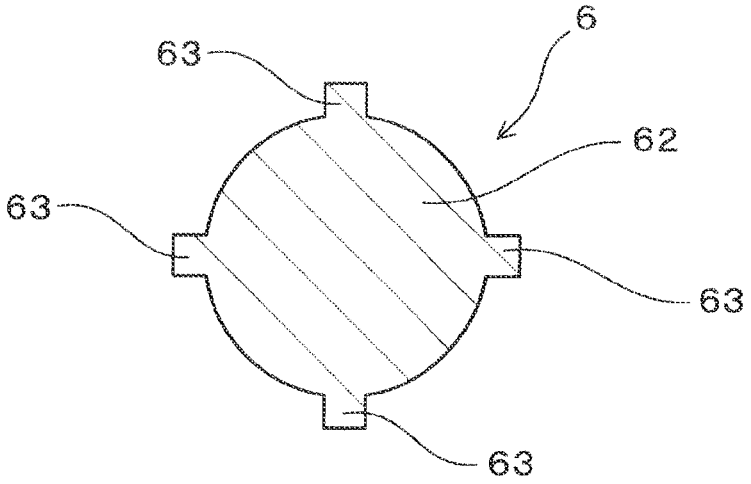
FIG. 3 is a cross-sectional view of FIG. 2 taken along line III-III.
Figure 4:
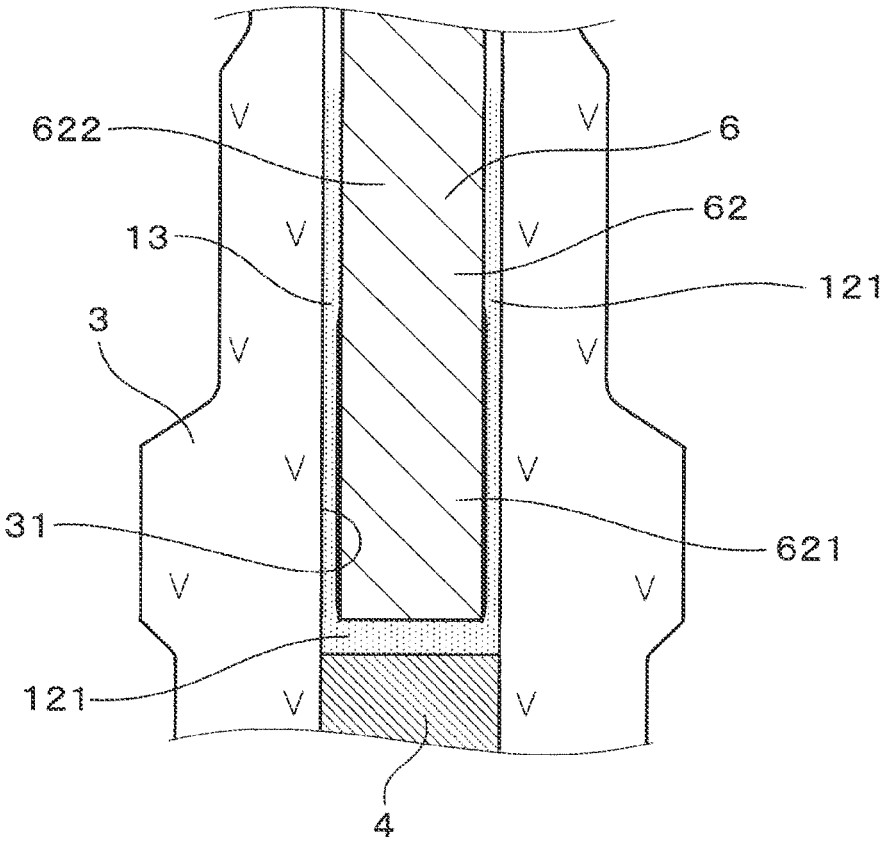
FIG. 4 is a diagram showing a sealing member disposed between the terminal metal fitting and an insulator of the spark plug according to the first embodiment of the invention.

As shown in FIGS. 1 and 2, the terminal metal fitting 6 includes an engaging portion 61 engaged to the inner peripheral surface of the proximal end portion of the insulator 3, and a small-diameter portion 62 extending from the engaging portion 61 and having a diameter smaller than the diameter of the engaging portion 61. As shown in FIGS. 2 and 3, the small-diameter portion 62 is formed with ribs 63 projecting outward from the outer peripheral surface thereof and extending in the axial direction. As shown in FIGS. 1 and 4, the sealing member 121 is located also at a part of a gap 13 on the distal end side, the gap 13 being located between the outer peripheral surface of the terminal metal fitting 6 and the inner peripheral surface of the insulator 3.

The insulator 3 has a cylindrical shape having an axial hole 31 penetrating therethrough in the axial direction. The center electrode 4, the sealing member 122, the resistor 7, the sealing member 121 and the terminal metal fitting 6 are disposed in the axial hole 31 in this order from the distal end side. The insulator 3 includes a step portion 32 at which the inner diameter of the axial hole 31 is changed. The center electrode 4 includes a brim portion 42 formed at its proximal end portion, the brim portion 41 being retained by the step portion 32, so that the center electrode 4 is positioned in the axial direction within the insulator 3.

The sealing members 121 and 122 are made of conductive copper glass which is a mixture of copper and glass. The sealing member 122 disposed on the distal end side of the resistor 7 adheres to the proximal end portion of the center electrode 4, the distal end portion of the resistor 7 and the inner peripheral surface of the insulator 3. The resistor 7 is made of a mixture of carbon and glass, and has a certain electrical resistance. The sealing member 121 disposed on the proximal end side of the resistor 7 adheres to the proximal end portion of the resistor 7, the distal end portion of the terminal metal fitting 6 and the inner peripheral surface of the insulator 3.

As shown in FIGS. 1 and 2, the terminal metal fitting 6 includes a terminal portion 64 for electrical connection with an ignition coil (not shown) on the proximal end side of the engaging portion 61. The terminal portion 64 is exposed to the proximal end side of the insulator 3. The engaging portion 61 has a diameter which is approximately the same as the inner diameter of the insulator 3 (the diameter of the axial hole 31). The engaging portion 61 is formed with a tapered portion 611 at the distal end portion thereof, the diameter of the tapered portion 611 decreasing toward the small-diameter portion 62.

The small-diameter portion 62 includes an uneven surface portion 621 formed at its distal end portion, and a middle portion 622 formed between the uneven surface portion 621 and the engaging portion 61. The uneven surface portion 621 may have a screw shape or a knurling shape.

The small-diameter portion 62 is formed with three or more ribs 63. In this embodiment, four ribs 63 are formed at even intervals in the circumferential direction of the small-diameter portion 62. The four ribs 63 have the same projection height and the same axial length. Accordingly, the shape of the small-diameter portion 62 including the ribs 63 is rotation symmetric with respect to the center axis thereof. In this embodiment, the small-diameter portion 62 including the ribs 63 has four-fold symmetry.

As shown in FIG. 2, the ribs 63 are formed so as to extend throughout the axial length of the small-diameter portion 62, and connect to the distal end of the engaging portion 61. Each of the ribs 63 includes a distal tapered portion whose projection height decreases toward the distal end side.

The ribs 63 project outward from the outer periphery of the small-diameter portion 62 to such an extent that they do not project beyond the outer shape of the engaging portion 61. Accordingly, the diameter of the circumscribed circle connecting the projection ends of the ribs 63 in the cross section of the terminal metal fitting 63 perpendicular to the axial direction (see FIG. 3) is smaller than the diameter of the engaging portion 61 and larger than the diameter of the small-diameter portion 62.

The diameter of the small-diameter portion 62 is smaller than the inner diameter of the insulator 3 (the diameter of the axial hole). Accordingly, as shown in FIG. 4, the gap 13 is present between the outer peripheral surface of the small-diameter portion 62 and the inner peripheral surface of the insulator 3. The gap 13 connects to the space between the distal end surface of the terminal metal fitting 6 and the proximal end surface of the resistor 7. The sealing member 121 is located also at a part on the distal end side of the gap 13. Accordingly, a part of the sealing member 121 located between the distal end surface of the terminal metal fitting 6 and the proximal end surface of the resistor 7 creeps up into the cylindrical gap 13 around the outer periphery of the small-diameter portion 62.

Figure 5:
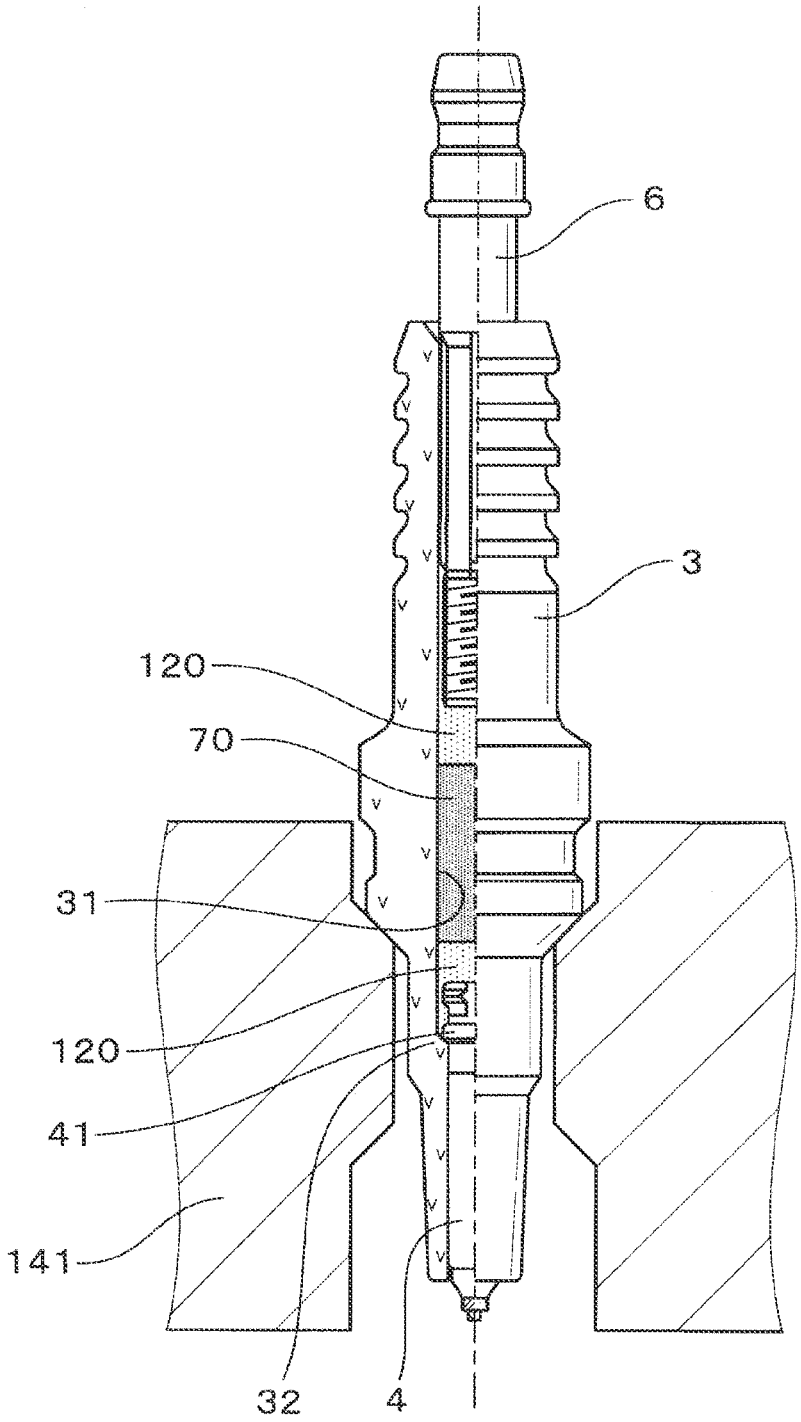
FIG. 5 is a diagram showing the spark plug according to the first embodiment immediately before the terminal metal fitting is pushed into the insulator.

At the time of assembling the center electrode 4, the sealing member 122, the resistor 7, the sealing member 121 and the terminal metal fitting 6 inside the insulator 3 to manufacture the spark plug 1, the insulator 3 is held in a holding jig 141 such that the proximal end faces upward as shown in FIG. 5. In this state, the center electrode 4 is inserted into the insulator 3. Specifically, the center electrode 4 is inserted into the axial hole 31 of the insulator 31 from the proximal end side (from the upper side) such that the distal end portion of the center electrode 4 is exposed from the distal end of the insulator 3.

Next, as shown in FIG. 5, a copper glass powder 120 as a material of the sealing member 122 is put into the axial hole 31 of the insulator 3 on the proximal end side of the center electrode 4. Subsequently, a resistor powder 70 of a mixture of carbon and glass as a material of the resistor 7 is put into the axial hole 31 from the proximal end side, and then the copper glass powder 120 is put into the axial hole 31 from the proximal end side. Next, the terminal metal fitting 6 is inserted into the axial hole 31 of the insulator 3 from the proximal end side.

Figure 6:
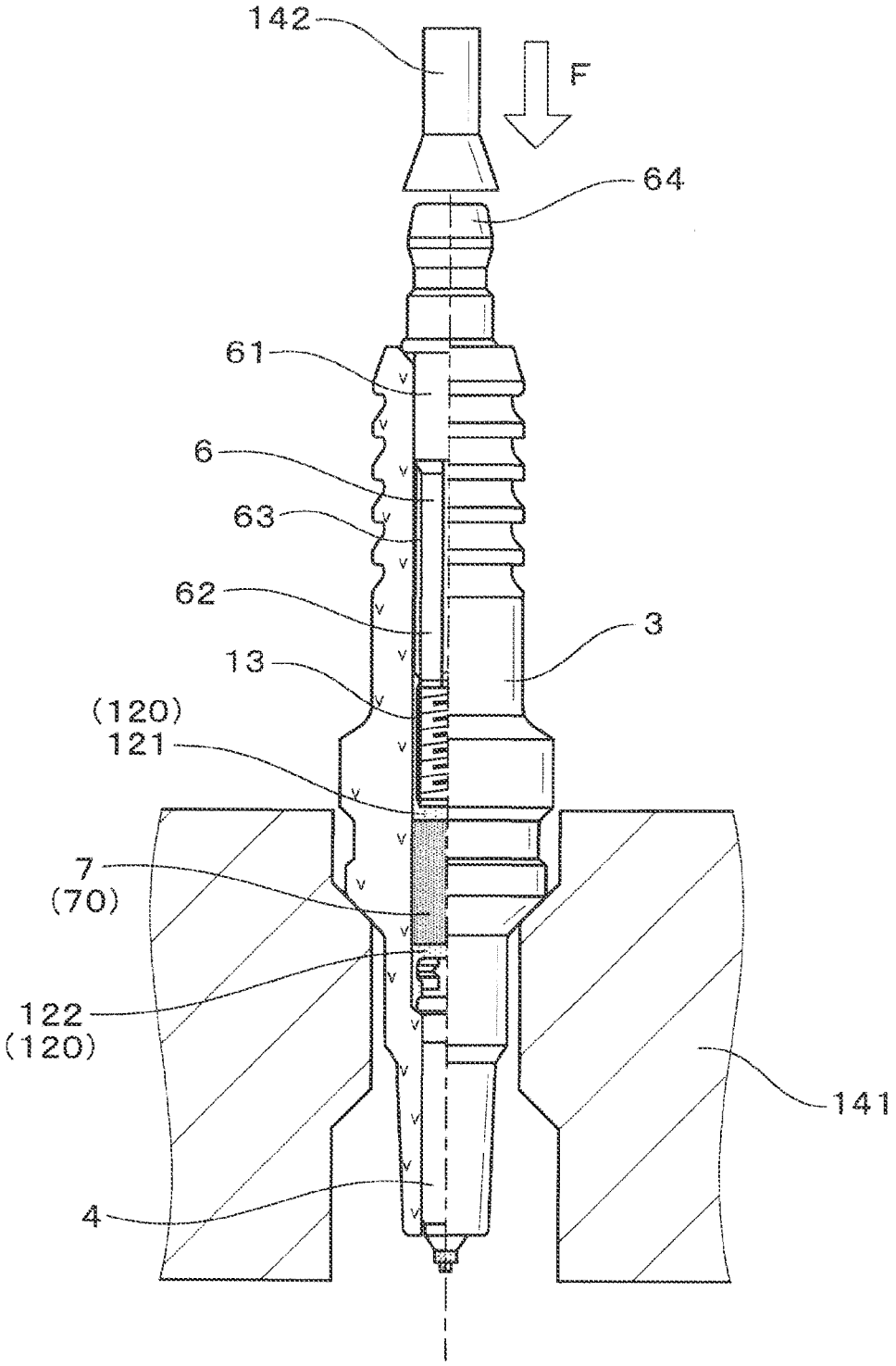
FIG. 6 is a diagram showing the spark plug according to the first embodiment immediately after the terminal metal fitting has been pushed into the insulator.

After that, as shown in FIG. 6, these components and materials are heated to a predetermined temperature and pushed toward the distal end side using a pushing jig 142 (see arrow F) until the engaging portion 61 is engaged into the axial hole 31. As a result, the copper glass powder 120 and the resistor powder 70 are melted and flow. A compressive force is applied to the melted copper glass and the resistor by the pushing jig 142. As shown in FIG. 4, part of the melted copper glass (the sealing member 121) creeps up into the gap 13 around the small-diameter portion 62 of the terminal metal fitting 6.

The sealing members (copper glass) 121 and 122 are cooled to be solidified adhering to the center electrode 4, the resistor 7 and the terminal metal fitting 6 within the insulator 3. In this way, the center electrode 4, the terminal metal fitting 6 and the resistor 7 are fixed within the insulator 3, and the inner space of the insulator 3 is sealed by the sealing members 121 and 122.

The first embodiment described above provides the following advantages. The small-diameter portion 62 of the terminal metal fitting 6 is formed with the ribs 63 which are arranged in the circumferential direction. This makes it possible to increase the rigidity of the small-diameter portion 62 to prevent deformation of the terminal metal fitting 6. That is, the small-diameter portion 62 can be prevented from being deformed when an axial force is applied to the terminal metal fitting 6 during assembly of the spark plug 1. Further, the provision of the ribs 63 in the small-diameter portion 62 makes it possible to increase the rigidity of the small-diameter portion 62 while ensuring the gap 13 in which the sealing member 121 is disposed between the outer peripheral surface of the small-diameter portion 62 and the inner peripheral surface of the insulator 3.

Since the rigidity of the small-diameter portion 62 is sufficiently increased by the ribs 63, the terminal metal fitting 6 can be designed freely without being restricted to any specific diameter or length of the small-diameter portion 62. Accordingly, the spark plug 1 can be designed to have a long-reach shape, or a small diameter, for example.

The small-diameter portion 62 is formed with three or more ribs 63 along the circumferential direction at even intervals. This makes it possible to effectively increase the rigidity of the small-diameter portion 62. That is, since the small-diameter portion 62 has three (or more)-fold symmetry, it can be prevented from being deformed in a specific direction when applied with a compressive force in the axial direction. Therefore, deformation of the small-diameter portion 62 can be effectively prevented, and variation of the pressing force applied to the resistor 7 and the sealing members 121 and 122 can be reduced. According to this embodiment, since the four ribs 63 are formed along the circumferential direction at even intervals, the rigidity of the small-diameter portion 62 can be more increased.

In addition, since the ribs 63 are connected to the distal end of the engaging portion 61, the rigidity of the terminal metal fitting 63 can be further increased.

According to this embodiment, there is provided a spark plug for an internal combustion engine, which can prevent deformation of its terminal metal fitting, and is high in design freedom.

Second Embodiment

Figure 7:
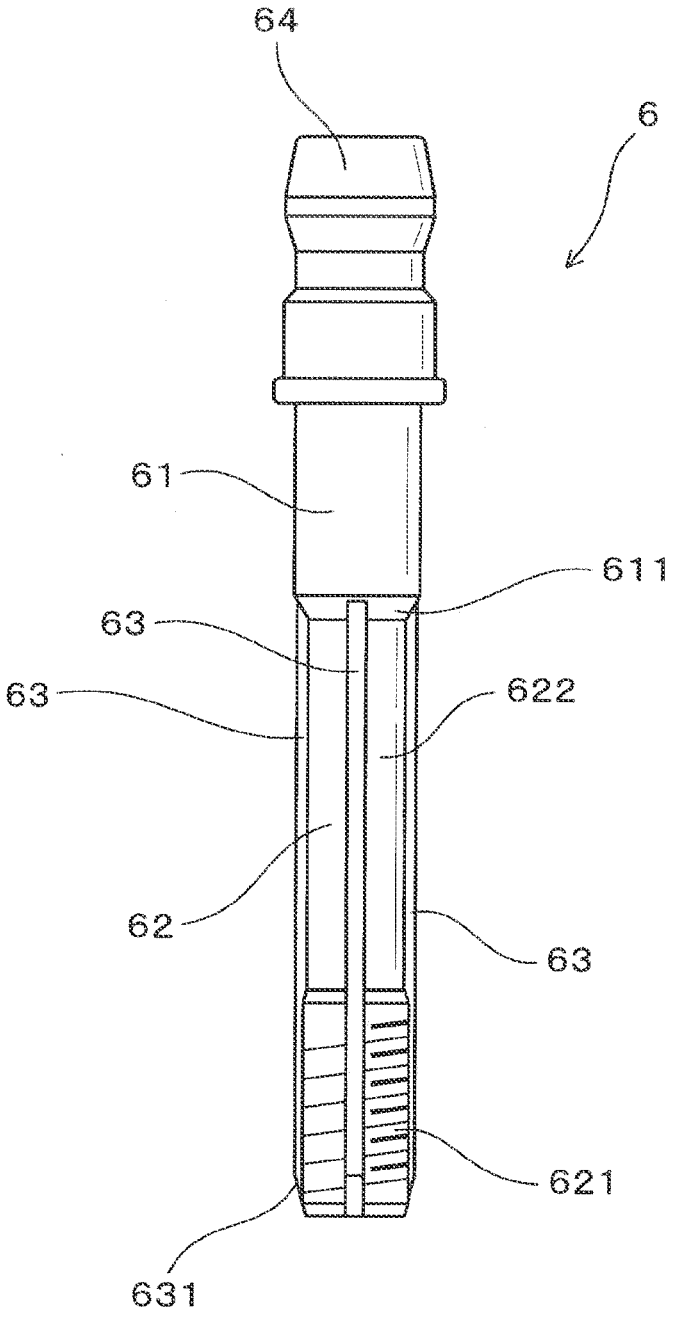
FIG. 7 is a front view of a terminal metal fitting of a spark plug according to a second embodiment of the invention.

Next, a second embodiment of the invention is described with reference to FIG. 7. As shown in FIG. 7, in the second embodiment, the ribs 63 are formed so as to extend throughout the axial length of the small-diameter portion 62. That is, the ribs 63 are formed over the middle portion 622 and the uneven surface portion 621. The proximal end portions of the ribs 63 coincide with the proximal end portion of the middle portion 622, and the distal end portions of the ribs 63 coincide with the distal end portion of the uneven surface portion 621. That is, the ribs 63 are formed so as to continue from the proximal end to the distal end of the small-diameter portion 62.

Except for the ribs 63, the second embodiment is the same in structure as the first embodiment.

According to the second embodiment, the rigidity of the small-diameter portion 62 can be further increased. Other than this, the second embodiment provides the same advantages as those provided by the first embodiment.

It is a matter of course that various modifications can be made to the above embodiments as described below. The number of the ribs 63 is not limited to four. It may be three, or more than or equal to five. The ribs 63 may be formed at a plurality of areas of the small-diameter portion 62, the areas being different in their axial positions.

The above explained preferred embodiments are exemplary of the invention of the present application which is described solely by the claims appended below. It should be understood that modifications of the preferred embodiments may be made as would occur to one of skill in the art.

What is claimed is:

1. A spark plug for an internal combustion engine, comprising:

a cylindrical housing;

a cylindrical insulator held inside the housing;

a center electrode held inside the insulator such that a distal end portion thereof projects from the insulator;

a terminal metal fitting held inside the insulator such that a proximal end portion thereof projects from the insulator;

a ground electrode disposed so as to form a spark discharge gap with the center electrode;

a resistor disposed inside the insulator so as to be located between the center electrode and the terminal metal fitting;

a first conductive sealing material filled in a space surrounded by the resistor, the terminal metal fitting and the insulator; and a second conductive insulating material filled in a space surrounded by the resistor, the center electrode and the insulator, wherein the terminal metal fitting includes an engaging portion engaged into an inner peripheral surface of the proximal end portion of the insulator and a small-diameter portion extending from the engaging portion and having a diameter smaller than a diameter of the engaging portion, the small-diameter portion is formed with ribs extending in an axial direction of the small-diameter portion and projecting outward from an outer peripheral surface of the small-diameter portion, and the first conductive sealing member is located at least at part on a distal end side of a gap between an outer peripheral surface of the terminal metal fitting and the inner peripheral surface of the insulator.

2. The spark plug for an internal combustion engine according to claim 1, wherein the ribs formed in the small-diameter portion are at least three in number, the ribs being arranged at even intervals in a circumferential direction of the small-diameter portion.

3. The spark plug for an internal combustion engine according to claim 1, wherein the ribs are formed so as to connect to a distal end of the engaging portion.

* * * * *